US005708936A

United States Patent [19]

Wang et al.

[11] Patent Number: 5,708,936

[45] Date of Patent: Jan. 13, 1998

[54] HYDRODYNAMICALLY STABLE COATING FLOW APPLICATOR

[75] Inventors: Fong-Jen Wang, Pittsford; Gerald A. Domoto, Briarcliff Manor; Paul W. Morehouse Jr., Webster; John F. Knapp, Fairport, all of N.Y.; Thomas A. Hanna, South Pasadena, Calif.; Stephen T. Chai, Rancho Palos Verdes, Calif.; Joseph F. Lacchia, Hacienda Heights, Calif.

[73] Assignee: Xerox Corporation, Stamford, Conn.

[21] Appl. No.: 707,350

[22] Filed: Sep. 3, 1996

[51] Int. Cl.[6] ..... G03G 15/10

[52] U.S. Cl. ..... 399/239; 399/246

[58] Field of Search ..... 399/237, 239, 399/246, 247, 238, 233, 225

[56] References Cited

U.S. PATENT DOCUMENTS

| | | | |
|---|---|---|---|
| 3,968,271 | 7/1976 | Egnaczak | 430/120 |
| 4,044,718 | 8/1977 | Blake et al. | 118/647 |
| 4,289,092 | 9/1981 | McChesney et al. | 118/660 |
| 4,398,818 | 8/1983 | Jeromin et al. | 355/10 |
| 4,827,309 | 5/1989 | Kata | 355/256 |
| 4,883,018 | 11/1989 | Sagiv | 118/660 |
| 5,202,534 | 4/1993 | Tamiya et al. | 399/238 |
| 5,300,990 | 4/1994 | Thompson | 355/260 |
| 5,355,201 | 10/1994 | Hwang | 399/241 |
| 5,519,473 | 5/1996 | Morehouse, Jr. et al. | 355/256 |

FOREIGN PATENT DOCUMENTS 08-211746 8/1996 Japan .

*Primary Examiner*—Joan H. Pendegrass
*Assistant Examiner*—Quana Grainger
*Attorney, Agent, or Firm*—Denis A. Robitaille

[57] ABSTRACT

An apparatus for developing an electrostatic latent image with liquid developing material. The apparatus includes a liquid developing material coating flow applicator for applying a substantially uniform coating of liquid developing material to a moving surface, wherein a housing, situated proximate to the moving surface, includes a fluid transport channel having a relatively narrow-width elongated outlet port for delivering a flow of liquid developing material to the moving surface, and an air flow channel having an elongated inlet aperture located adjacent the moving surface and immediately upstream from said outlet port for applying vacuum pressure to the flow of liquid developing material for varying the profile of the coating flow to provide variation of flow stability as well as thickness. A discussion of the effects of variations in the outlet port geometry, in particular, increasing the dimension between the downstream wall and the surface to be coated, has also been provided. A developing roll situated adjacent to and downstream from the liquid developing material is also provided for attracting the liquid developing material to image areas of the electrostatic latent image.

28 Claims, 4 Drawing Sheets

HYDRODYNAMICALLY STABLE COATING FLOW APPLICATOR

This invention relates generally to an electrostatographic printing machine, and more particularly concerns an apparatus for applying a liquid developer material to a latent image bearing surface such as a photoreceptive member in a liquid developing material-based xerographic copying or printing machine.

Generally, the process of electrostatographic copying is initiated by exposing a light image of an original document to a substantially uniformly charged photoreceptive member. Exposing the charged photoreceptive member to a light image discharges the photoconductive surface thereof in areas corresponding to non-image areas in the original input document while maintaining the charge in image areas, resulting in the creation of an electrostatic latent image of the original document on the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the patent image for forming a powder toner image on the photoreceptive member. Alternatively, liquid developer materials comprising a liquid carrier material having toner particles dispersed therein have been utilized, wherein the liquid developer material is applied to the latent image with the toner particles being attracted toward the image areas to form a liquid image. Regardless of the type of developer material employed, the toner particles of the developed image are subsequently transferred from the photoreceptive member to a copy sheet, either directly or by way of an intermediate transfer member. Once on the copy sheet, the image may be permanently affixed to provide a "hard copy" reproduction of the original document or file. In a final step, the photoreceptive member is cleaned to remove any charge and/or residual developing material from the photoconductive surface in preparation for subsequent imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the dis-charged area, known as DAD, or "write black" systems, in contradistinction to the light lens generated image systems which develop toner on the charged areas, knows as CAD, or "write white" systems. The subject invention applies to both such systems.

The use of liquid developer materials in imaging processes is well known. Likewise, the art of developing electrostatographic latent images formed on a photoconductive surface with liquid developer materials is also well known. Indeed, various types of liquid developing material development systems have heretofore been disclosed.

Liquid developers have many advantages. For example, images developed with liquid developers can be made to adhere to paper without a fixing or fusing step, thereby eliminating a requirement to include a resin in the liquid developer for fusing purposes. In addition, the toner particles can be made to be very small without resulting in problems often associated with small particle powder toners, such as airborne contamination which can adversely affect machine reliability and can create potential health hazards. The use of very fine toner particles enable the production of higher quality images than those generally formed with dry toners. In full color imaging processes, production of a texturally attractive output document is enabled through the use of liquid developers due to minimal multilayer toner height build-up (whereas full color images developed with dry toners often exhibit substantial height build-up of the image in regions where color areas overlap). In addition, full color imaging with liquid developers is economically attractive, particularly if surplus liquid carrier containing the toner particles can be economically recovered without cross contamination of colorants. Further, full color prints made with liquid developers can be processed to a substantially uniform finish, whereas uniformity of finish is difficult to achieve with powder toners due to variations in the toner pile height as well as a need for thermal fusion, among other factors.

Although specific liquid development systems may vary, one well known type of system includes a roll member adapted to transport liquid developer material into a position proximate to the photoconductive surface such that the electrostatic latent image recorded thereon can attract toner particles from the liquid developer material in an image configuration. In such systems, the roll member is typically partly submerged in a sump of liquid developer material with the roll member being rotated at a sufficiently high velocity so as to transport the liquid developer to the surface of the photoreceptor in the form of a relatively thin toner layer formed along the surface of the roll member. In addition, an electrical field is generally induced across a gap between the photoconductive surface and the roll member by applying an electrical bias to the roll member for maintaining a toning meniscus across the gap to provide a desired density of toner particles entrained in the liquid developer and to reduce undesirable background staining of the photoreceptor as it passes the developer apparatus.

Generally, in the field of electrostatographic printing and copying, development of a latent image takes place at high speeds, which requires that a large amount of uniformly characteristic liquid developer material be supplied to the photoconductive surface as uniformly as possible to produce a high quality image without any variations in the development thereof. However, it has been found in the roll development system of the type described hereinabove, that it may be difficult to uniformly apply the liquid developer material to the entire surface of the developing roll member. Furthermore, since the amount of liquid developer applied to the photoconductive surface is limited to the amount of developing material applied to the surface of the developing roll member, it is typically difficult to apply a relatively large amount of developer material to the latent image. As a result, alternative systems have also been disclosed in the art, wherein the liquid developing material developer material is brought into contact with the latent image on the photoreceptor by means of a fountain-type apparatus, in which a flow of liquid developer material is pumped into a gap between a development electrode and the photoconductive surface for developing the latent image thereon. While this approach permits the application of large amounts of liquid developer to the latent image as compared to other methods, the problem of uniformity of the layer of liquid developing material placed on the photoreceptor remains an issue. Two dimensional liquid flow from an aperture typically generates three dimensional secondary flows known as ribbing instabilities due to the hydrodynamic instability of viscous incompressible flows caused by viscous stress. The stability of liquid flow is governed by various factors, including flow geometry, which, in turn, can be manipulated to achieve a more stable coating process, and to produce a more uniform coating layer.

Thus, some problems and inadequacies remain with respect to known apparatus used for liquid developing material development in the field electrostatographic printing. The following disclosures may be relevant to some aspects of the present invention:

U.S. Pat. No. 4,044,718 Patentee: Blake et. al. Issued: Aug. 30, 1977

U.S. Pat. No. 4,289,092 Patentee: McChesney et. al. Issued: Sep. 15, 1981

U.S. Pat. No. 4,398,818 Patentee: Jeromin et. al. Issued: Aug. 16, 1983

U.S. Pat. No. 4,827,309 Patentee: Karo Issued: May 2, 1989

U.S. Pat. No. 4,883,018 Patentee: Sagiv Issued: Nov. 28, 1989

U.S. Pat. No. 5,300,990 Patentee: Thompson Issued: Apr. 5, 1994

U.S. Pat. No. 5,519,473 Patentee: Morehouse, Jr. et al. Issued: May 21, 1996

The relevant portions of the foregoing patents may be briefly summarized as follows:

U.S. Pat. No. 4,044,718 discloses a fountain for moving liquid toner into engagement with a receptor for developing an electrostatic image into a visible image. The fountain incorporates an electrode positioned at the bottom of a liquid toner pool formed by electrical insulating end, side, and bottom members.

U.S. Pat. No. 4,289,092 discloses a liquid development fountain having plural spaced slots in its upper surface against which a record baring material is passed and through which developer is moved in a sinuous path to repetitively contact the record member through the slots.

U.S. Pat. No. 4,398,818 discloses a liquid toner fountain for the development of electrostatic images including multiple distribution plates with lateral liquid distribution for producing smooth streamline flow, a slotted metalized plastic electrode, and a funnel shaped understructure which drains access toner liquid into a sump to recover developer and prevent evaporation. The apparatus provides a laminar liquid flow in a gap between a charge bearing surface and a development electrode to prevent disturbance of already deposited toner and also provides an even flow rate along the length of the fountain for avoiding density radiance due to uneven flow rates. The developer fluid in the gap is maintained free of debris by draining off all fluid into the sump.

U.S. Pat. No. 4,827,309 discloses a liquid developing apparatus with a plurality of fountains and discharge slits arranged alternately in parallel to each other and extending laterally. Each fountain slit is coupled to a cylindrical developer guide having a hollow pipe member including supply openings inserted therein for producing liquid developer jets which move upward to the latent image carrier through the fountain slits and are subsequently discharged through discharge slits located on either sides of the fountain slits.

U.S. Pat. No. 4,883,018 discloses a liquid developing material development system, wherein a liquid developer material is pumped partially upward from a lowermost region of a development zone toward an uppermost region thereof, thereby forming a pressure barrier which prevents the escape of liquid developer material from the lowermost region of the development zone. A ceiling roller prevents the escape of liquid developer material from the uppermost region of the development zone.

U.S. Pat. No. 5,300,990 discloses a liquid electrophotographic printer developer for a laser printer, including a bath of liquid toner, a charged reverse direction developer roller, and in relatively close spaced relationship from it, a same direction rigidizing/squeegee roller charged to about the same potential as the developer roller. A common wiping means is provided for cleaning both the developer and the rigidizing/squeegee rollers and directing access toner into a recycle system. In a preferred embodiment, a series of developer systems with different colored toners are employed to create a multicolor image on a copy sheet.

U.S. Pat. No. 5,519,473 discloses an apparatus for developing an electrostatic latent image with liquid developing material. The apparatus includes a liquid developing material applicator, wherein a single piece housing fabricated from a non-conductive material is defines an elongated aperture adapted for transporting liquid developing material into contact with the image on the surface of a photoreceptive member. The housing further includes a planar surface adjacent the elongated aperture for providing a liquid developing material application region in which the liquid developing material can flow freely in contact with the photoreceptive member. A developing roll situated adjacent to and downstream from the liquid developing material is also provided for attracting the liquid developing material to image areas of the electrostatic latent image.

In accordance with one aspect of the present invention, there is provided a liquid developing material coating flow applicator for applying a substantially uniform coating of liquid developing material to a moving surface, comprising: a housing situated proximate to the moving surface; the housing defining a fluid transport channel coupled to an elongated outlet port located adjacent the moving surface for delivering a flow of liquid developing material thereto; and the housing further defining an air flow channel coupled to an inlet port located adjacent the moving surface and immediately upstream from the elongated outlet port for applying vacuum pressure to the flow of liquid developing material.

In accordance with another aspect of the present invention, an apparatus for developing an electrostatic latent image on an imaging member with a liquid developing material is provided, the apparatus comprising: a liquid developing material coating flow applicator for applying a substantially uniform coating of liquid developing material to an imaging member, including a housing situated proximate to the imaging member; the housing defining a fluid transport channel coupled to an elongated outlet port located adjacent the imaging member for delivering a flow of liquid developing material thereto; the housing further defining an air flow channel coupled to an inlet port located adjacent the imaging member and immediately upstream from the elongated outlet port for applying vacuum pressure to the flow of liquid developing material; and a metering roll situated adjacent the liquid developing material coating flow applicator and downstream therefrom relative to a path of travel of the imaging member.

In accordance with another aspect of the present invention, a liquid ink type electrostatographic printing machine is provided, including an apparatus for developing an electrostatic latent image on a photoreceptive member with a liquid developing material, comprising: a liquid developing material coating flow applicator for applying a substantially uniform coating of liquid developing material to a photoreceptive member, including a housing situated proximate to the photoreceptive member; the housing defining a fluid transport channel coupled to an elongated outlet port located adjacent the photoreceptive member for delivering a flow of liquid developing material thereto; and the housing further defining an air flow channel coupled to an inlet port located adjacent the photoreceptive member and immediately upstream from the elongated outlet port for applying vacuum pressure to the flow of liquid developing material; and a metering roll situated adjacent said liquid developing material coating flow applicator and downstream therefrom relative to a path of travel of the photoreceptive member.

Other aspects of the present invention will become apparent as the following description proceeds and upon reference to the drawings, in which.

Figure 3A:
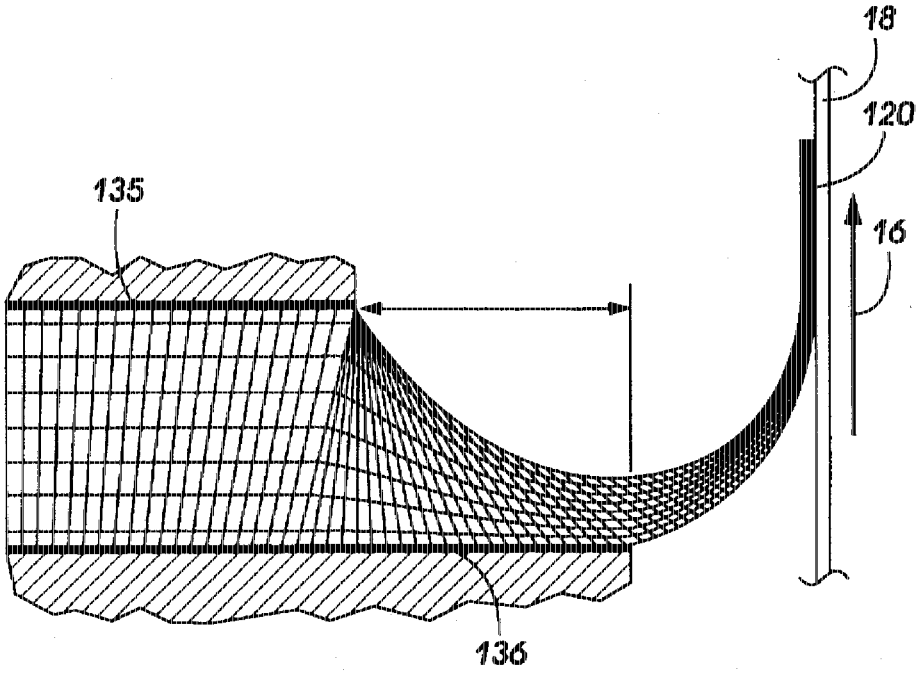
Figure 3B:
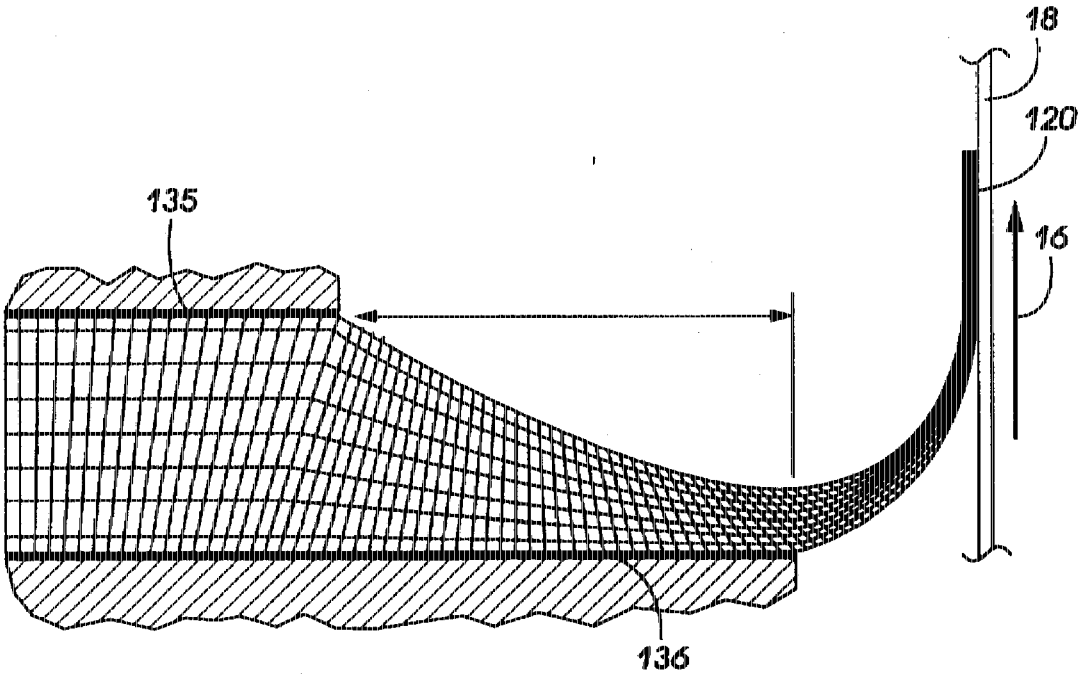
Figure 4:
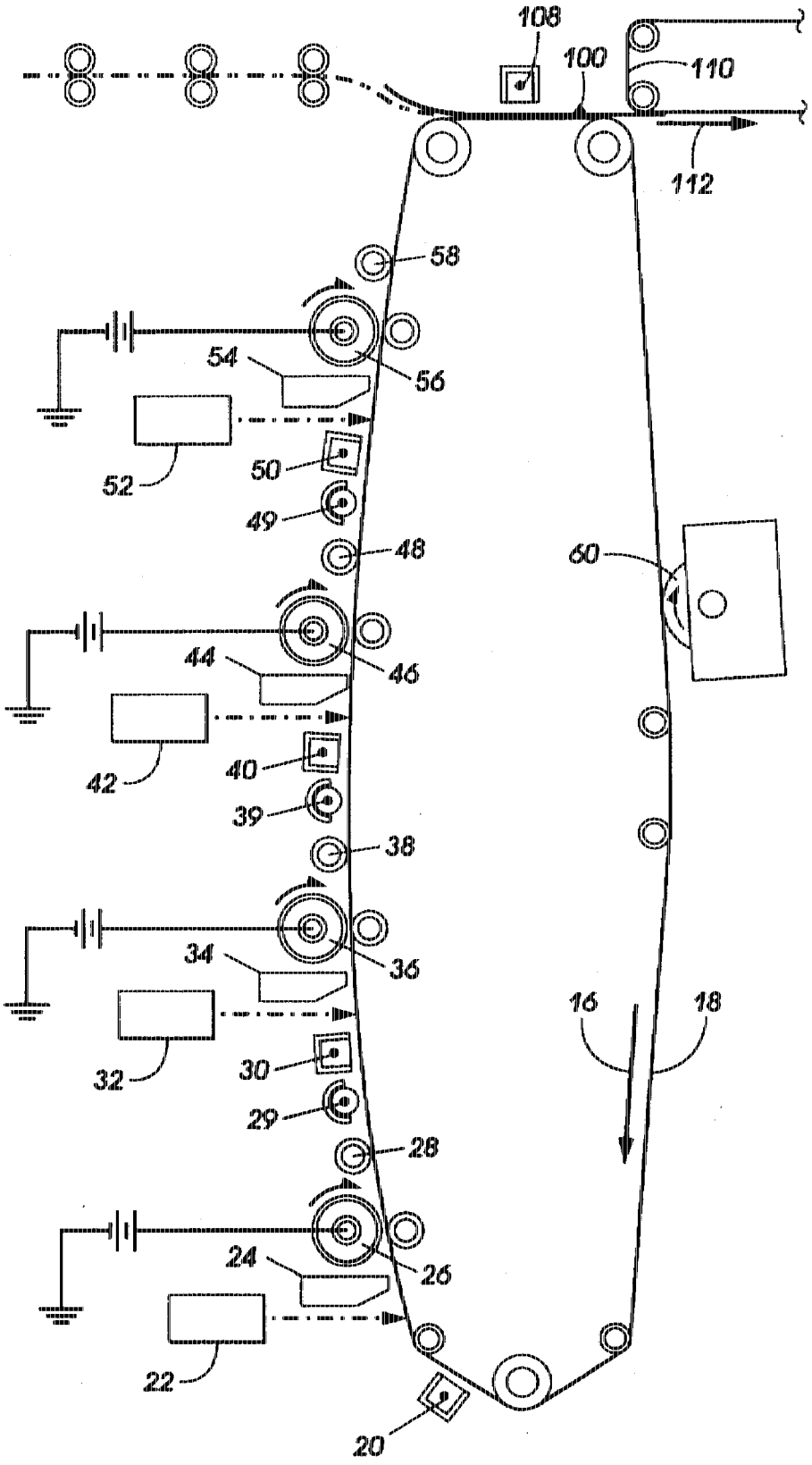

FIGS. 3A and 3B are computational mesh representations illustrating the coating flow profile of liquid developing material utilizing various alternative embodiments of the liquid developing material coating flow applicator of the present invention, wherein geometric parameters of the coating flow applicator outlet port are varied; and FIG. 4 is schematic, elevational view of a color electrostatographic printing machine utilizing the liquid developing material coating flow applicator of the present invention.

For a general understanding of the features of the present invention, reference is made to the drawings, wherein like reference numerals have been used throughout to designate identical elements. FIG. 4 is a schematic elevational view illustrating an exemplary full-color, single-pass, image-on-image, liquid developing material based electrostatographic printing machine incorporating the features of the present invention. It will become apparent from the following discussion that the apparatus of the present invention may be equally well-suited for use in a wide variety of printing processes and machine architectures such that the present invention is not necessarily limited in its application to the particular electrostatographic process or system described herein. Thus, although the present invention will be described in connection with a preferred embodiment thereof, it will be understood that the description of the invention is not intended to limit the invention to this preferred embodiment. Indeed, the description is intended to cover all alternatives, modifications, and equivalents as may be included within the spirit and scope of the invention as defined by the appended claims.

Turning now to FIG. 4, inasmuch as the art of electrostatographic printing is well known, the various processing will be described briefly with reference thereto. The liquid developing material based multicolor electrostatographic printing machine employs a photoreceptor in the form of a continuous multilayered belt member, generally comprising a photoconductive surface deposited on an electrically grounded conductive substrate. The photoreceptor 18 is entrained about a plurality of rollers, at least one of which is rotatably driven by a drive mechanism (not shown) for advancing the belt along a curvilinear path in the direction of arrow 16, such that successive portions of the photoreceptive belt 18 can be transported through the various processing stations disposed about the path of movement thereof.

The electrostatographic printing process is initiated by applying a substantially uniform charge potential to the photoreceptive member 18. As such, an initial processing station is shown as a charging station, including a corona generating device 20. The corona generating device 20 is capable of applying a relatively high and substantially uniform charge potential to the surface of the photoreceptor belt 18.

After the substantially uniform charge is placed on the surface of photoreceptor belt 18, the electrostatographic printing process proceeds by either imaging an input document placed on the surface of a transparent imaging platen (not shown), or by providing a computer generated image signal, for selectively discharging the photoconductive surface in accordance with the image to be generated. For multicolor printing and copying, the imaging process involves separating the imaging information into the three primary colors plus black to provide a series of subtractive imaging signals, with each subtractive imaging signal being proportional to the intensity of the incident light of each of the primary colors or black. These imaging signals are then transmitted to a series of individual raster output scanners (ROSs), shown schematically by reference numerals 22, 32, 42 and 52, for generating complementary color-separated latent images on the charged photoreceptive belt 18. Typically, each ROS 22, 32, 42 and 52 writes the latent image information in a pixel by pixel manner.

Each of these color-separated electrostatic latent images are serially developed into visible images on the photoreceptive belt 18. In accordance with the present invention, development of each color-separated image is developed via a so-called coating flow applicator identified in FIG. 4 by reference numerals 24, 34, 44 and 54. Each coating flow applicator operates as an apparatus for transporting liquid developing material and for applying a thin coating layer of liquid developing material to the surface of belt 18. Thereafter, the latent image coated with liquid developing material is developed by means of a biased metering roll, generally identified by reference numerals 26, 36, 46 or 56. The detailed structure for a particular embodiment of the coating flow applicator contemplated by the present invention, and alternative embodiments thereof, as well as the operation thereof, will be described hereinafter with reference to FIGS. 1–3.

As previously noted, the present invention is advantageously utilized in a color electrostatographic printing system which utilizes liquid developer materials. Thus, each coating flow applicator transports a different color liquid developing material into contact with the electrostatic latent image on the photoreceptor surface so as to develop the latent image with pigmented toner particles, creating a visible image. By way of example, coating flow applicator 24 transports cyan colored liquid developer material, coating flow applicator 34 transports magenta colored liquid developer material, coating flow applicator 44 transports yellow colored liquid developer material, and coating flow applicator 54 transports black colored liquid developer material. Each different color liquid developing material comprises pigmented toner particles immersed in a liquid carrier medium, wherein the toner particles are charged to a polarity opposite in polarity to the latent image on the photoconductive surface of belt 18 such that the toner particles are attracted to the electrostatic latent image to create a visible developed image thereof.

Generally, in a liquid developing material-based system, the liquid carrier medium makes up a large amount of the liquid developer composition. Specifically, the liquid medium is usually present in a range of from about 80 to about 98 percent by weight in the developing material, although this amount may vary outside of the stated range. By way of example, the liquid carrier medium may be selected from a wide variety of materials, including, but not limited to, any of several hydrocarbon liquids, such as high purity alkanes having from about 6 to about 14 carbon atoms exemplified by such commercial products as: Norpar® 12; Norpar® 13; and Norpar® 15; as well as isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons may provide a preferred liquid media since they are colorless, environmentally safe, and possess a sufficiently high vapor pressure so that a thin film of the liquid evaporates from the contacting surface within seconds at ambient temperatures.

The toner particles utilized in liquid developer compositions can be any pigmented particle compatible with the liquid carrier medium, such as, for example, those disclosed in U.S. Pat. Nos. 3,729,419; 3,841,893; 3,968,044; 4,476,210; 4,707,429; 4,762,764; 4,794,651; 5,066,559 and 5,451,483, among various other patents and disclosures known to one of skill in the art. Preferably, the toner particles have an average particle diameter from about 0.2 to about 10 microns, and more preferably in the range from about 0.5 to about 2 microns. In addition, the toner particles may be present in amounts of from about 1 to about 10 percent by weight, and preferably from about 1 to about 4 percent by weight of the developer composition. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, A ax, Ontario, Bismark Brown R (Aldrich) , Neolan Blue (Ciba-Geigy) , Saviny Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Colombian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

In addition to the liquid carrier vehicle and toner particles which typically make up the liquid developer materials suitable for the present invention, a charge control additive, sometimes referred to as a charge director, may also be included for facilitating and maintaining a uniform charge on toner particles by imparting an electrical charge of selected polarity (positive or negative) to the toner particles. Examples of suitable charge control agents include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

During or after image development, the amount of liquid developing material, and in particular the liquid carrier portion of the liquid developing material that is deposited on the surface of the photoreceptor belt 18 is preferably reduced by an incipient amount. To this end, with respect to the system of FIG. 4, metering rollers 26, 36, 46 and 56 are positioned slightly downstream of, and adjacent to, respective developing material coating flow applicators 24, 34, 44 and 54, in the direction of movement of the photoreceptor 18. Preferably, the peripheral surface of each metering roller is situated in close proximity to the surface of the photoreceptor 18 and may or may not contact the surface of the photoreceptor 18 and/or the liquid coating layer thereon. In addition, the peripheral surface of the metering roller 26 is preferably rotated in a direction opposite the path of movement of the photoreceptor in order to create a substantial shear force against the thin layer of liquid developing material present between it and the photoreceptor 18. This shear force removes a predetermined amount of excess developing material, in particular carrier liquid, from the surface of the photoreceptor and transports this excess developing material in the direction of the developing material flow applicator 24, with the excess developing material eventually falling away from the rotating metering roll 26 for collection in a sump (not shown) or other liquid developer collection and reclaim system.

As shown, the metering roll 26 may be electrically biased by supplying an AC or a DC voltage thereto for repelling or attracting toner particles present in the liquid developing material on the photoreceptor belt 18. It will be recognized that, by providing a predetermined electrical bias at the metering roll of the same charge polarity as the charge on the developed image, removal of deposited toner particles from the surface of the photoreceptor due to the shear forces created by the movement of the metering roll can be inhibited. Conversely, by providing a predetermined electrical bias to the metering roll which is opposite in polarity to the charge of the developed image, background image removal can be induced, if desired.

After the above-described metering process is completed, the developed liquid image on the photoconductor may preferably be further processed or "conditioned" to pack or condense the image onto the surface of the photoreceptor and to further remove some of the liquid carrier therefrom. This basic concept is shown, for example, by previously cited U.S. Pat. No. 4,286,039, as well as U.S. Pat. Nos.

4,974,027 and 5,028,964, among various other patents. Thus, an image conditioning system may be utilized for conditioning a developed liquid image on a photoreceptor surface or on any surface which is used to transport a developed image (e.g. an intermediate transfer belt), or for conditioning a liquid ink layer on the photoreceptor surface or other surface, whereby the liquid ink is first subjected to a large electric field for electrostatically driving the colorant containing toner particles of the liquid ink toward the surface, followed by removal of excess liquid from the liquid ink layer on the belt surface. In either method of use, an exemplary embodiment of an ink conditioning system is shown at reference numerals 28,38,48 and 58 wherein a biased roller is urged against the photoreceptor 18 to electrostatically compress the liquid ink on the photoreceptor belt 18 while further removing excess liquid therefrom. It will be recognized that various biased devices for forming high electric fields, such as a corona generating device, an electrically biased non-contact blade member, a charging "shoe", or a non-contact biased roller, can also be used in combination with a non-biased contact roller as an alternative to the described apparatus.

Continuing with a general description of the multicolor liquid electrostatographic printing process, following ink conditioning, belt 18 continues to advance in the direction of arrow 16. The photoreceptor belt 18 is first optionally exposed to a flood lamp 29 for erasing any residual charge therefrom, and then moved to a subsequent recharge station where another corona generating device 30 is utilized to recharge the photoconductor belt 18, having a first developed color separation thereon, to a establish a new substantially uniform potential thereon. The belt then continues to travel to the next exposure station, where ROS 32 selectively dissipates the charge laid down by corotron 30 to record another color separated electrostatic latent image corresponding to regions to be developed with a magenta developer material. This color separated electrostatic latent image may be totally or partially superimposed on the image previously developed on the photoconductive surface. Thereafter, the electrostatic latent image is advanced to the next successive coating flow applicator 34 which deposits magenta toner thereon.

After the electrostatic latent image has been developed with magenta toner, the photoconductive surface of belt 18 continues to be advanced in the direction of arrow 16 to the next metering roll 36, to the next image conditioning station 38 and onward to flood lamp 39 and corona generating device 40, which, once again, recharges the photoconductive surface to a substantially uniform potential. Thereafter, ROS 42 selectively discharges this new charge potential on the photoconductive surface to record yet another color separated electrostatic latent image, which may be partially or totally superimposed on the prior cyan and magenta developed images, for development with yellow toner. In this manner, a yellow toner image is formed on the photoconductive surface of belt 18 in superimposed registration with the previously developed cyan and magenta images. It will be understood that the color of the toner particles at each development station may be provided in an arrangement and sequence that is different than described herein.

After the yellow toner image has been formed on the photoconductive surface of belt 18, the belt 18 continues to advance to the next metering roller 46, image conditioning station 48, and onward to flood lamp 49 and recharge station 50 and corresponding ROS 52 for selectively discharging those portions of belt 18 which are to be developed with black toner. In this final development step, black images are developed via a process known as black undercolor removal process, wherein the developed image is located only on those portions of the photoconductive surface adapted to have black in the printed page and may not be superimposed over the prior cyan, magenta, and yellow developed images. This final developed image is once again metered and image conditioned at an image conditioning station 58 to compact the image and subsequently remove excess liquid from the image.

Using the process described hereinabove, a composite multicolor toner image is formed on the photoconductive surface of belt 18. It will be recognized that the present description is directed toward a Recharge, Expose, and Develop (READ) process, wherein the charged photoconductive surface of photoreceptive belt 18 is serially exposed to record a series of latent images thereon corresponding to the subtractive color of one of the colors of the appropriately colored toner particles at a corresponding development station. Thus, the photoconductive surface is continuously recharged and re-exposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD), wherein discharged portions are developed, or charged area development (CAD), wherein charged areas are developed can be employed, as will be described.

After the composite multicolor image is formed on the photoreceptor the multilayer developed image may be further conditioned with corona and/or light and then advanced to a transfer station, whereat a sheet of support material 100, typically a sheet of paper or some similar sheet-like substrate, is guided into contact with the photoreceptor 18. At the transfer station, a corona generating device 108 directs ions onto the back side of the support material 100 for attracting the composite multicolor developed image on belt 18 to the support material 100. While direct transfer of the composite multicolor developed image to a sheet of paper has been described, one skilled in the art will appreciate that the developed image may be transferred to an intermediate member, such as a belt or drum, and then, subsequently, transferred and fused to the sheet of paper, as is well known in the art.

After the image has been transferred to the support substrate, a conveyor belt 110 moves the sheet of paper in the direction of arrow 112 to a drying or fusing station (not shown). The fusing station may include a heated roll in combination with a back-up or pressure roll, the rolls being resiliently urged into engagement with one another to form a nip through which the sheet of paper passes. The fusing station operates to affix the toner particles to the copy substrate so as to bond the multicolor image thereto. After fusing, the finished sheet is discharged and further transported for removal by the machine operator.

Often, after the developed image is transferred from belt 18, residual developer material tends to remain, undesirably, on the surface thereof. In order to remove this residual toner from the surface of the belt 18, a cleaning roller 60, typically formed of an appropriate synthetic resin, is driven in a direction opposite to the direction of movement of belt 18 for contacting and cleaning the surface thereof. It will be understood that a number of photoconductor cleaning means exist in the art, any of which would be suitable for use with the present invention.

The foregoing discussion provides a general description of the operation of a liquid developing material based electrostatographic printing machine incorporating the present invention therein. The detailed structure of the liquid developing material coating flow applicator will be described hereinafter with reference to FIGS. 1–3. It will be understood that the coating flow applicator of the present invention may be utilized in a multicolor electrophotographic printing machine as well as in a monocolor printing machine. The developed image may be transferred directly to the copy sheet, as described, or to an intermediate member prior to transfer to the copy sheet. Multicolor printing machines may use this type of development unit where successive latent images are developed to form a composite multicolor toner image which is subsequently transferred to a copy sheet or, in lieu thereof, single color liquid images may be transferred in superimposed registration with one another directly to the copy sheet or to an intermediate transfer member in like manner. It will be understood that each liquid developing material coating flow applicator 24, 34, 44 and 54, shown in the apparatus of FIG. 4 is substantially identical. In General, the only distinction between applicators 24, 34, 44 and 54 is the color of the liquid developer material transported therethrough.

Figure 1:
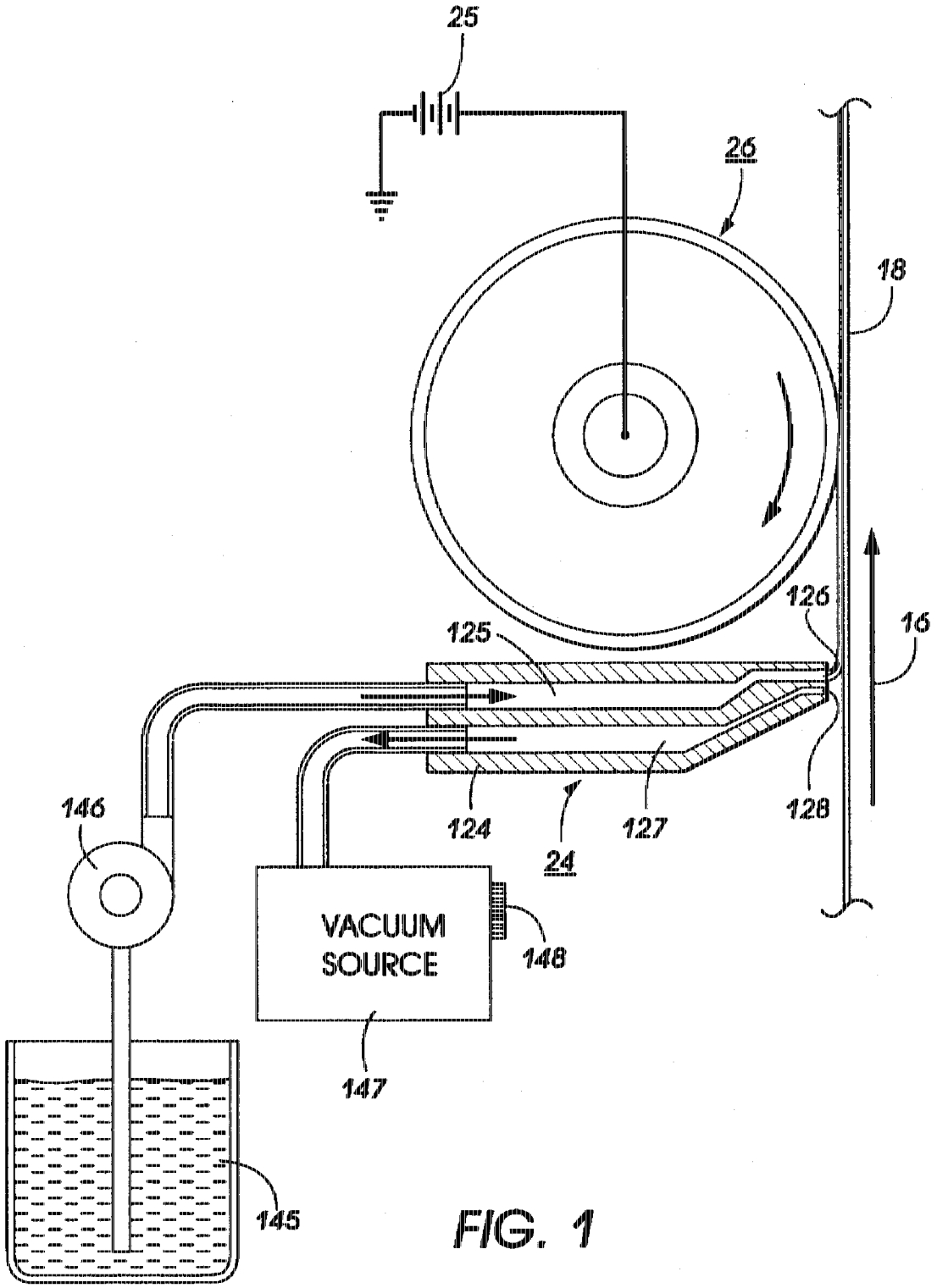
FIG. 1 is a plan view of one embodiment of the liquid developing material coating flow applicator of the present invention as may be incorporated into a liquid developing station including a metering roll.

Referring now to FIG. 1, each developer subsystem includes a coating flow applicator in accordance with the present invention, in combination with a metering roll 26, wherein the applicator 24 and roll 26 are situated adjacent to one another and in close proximity to the surface of photoreceptive belt 18. Metering roll 26 is positioned slightly downstream of and adjacent to the liquid developing material coating flow applicator 24, relative to the direction of movement of the photoreceptor surface 18. A DC power supply 25 is provided for maintaining an electrical bias on the metering roll at a selected polarity. As previously described, the liquid developing material coating flow applicator 24 deposits a thin coating of developer material on the photoreceptor 18, while the image areas of the electrostatic latent image thereon attract toner particles from this liquid developing material coating layer to produce a developed image. The metering roll 26 preferably provides an electrical bias for repelling toner particles toward the image areas on the photoreceptor, resulting in an electrophoretic development process which minimizes the existence of toner particles in background regions and maximizes toner deposition in image areas on the photoreceptor.

Typically, the peripheral surface of the metering roller 26 is located within about 0.002 to 0.003 inches from the surface of the photoreceptor 18. In addition, the metering roll 26 may be rotated in a direction opposite the movement of the photoconductor surface, Generating a substantial shear force on the coating of developer material deposited on the photoreceptor in the area of the nip between the metering roller and the photoreceptor. This shear force removes a predetermined amount of the liquid carrier from developer material coating layer on the surface of the photoreceptor and transports the excess liquid carrier away from the photoreceptor surface, thereby minimizing the thickness of the coating of developer liquid on the surface of the photoreceptor. The excess developer material eventually falls away from the rotating metering roll for collection in a sump (not shown).

The coating flow applicator 24 of the present invention includes a housing 124, preferably having a single piece construction fabricated from a suitable conductive or nonconductive material such as a polycarbonate or other reinforced polymer based material, whereby fabrication and manufacturing can be accommodated by light machining or via plastic extrusion. The housing 124 includes a fluid transport channel 125 leading to an output port 126 in the form of a first elongated aperture extending along a longitudinal axis of the housing 124, oriented substantially transverse to the belt 18 along the direction of travel thereof, as indicated by arrow 16. Preferably, the width of the elongated aperture of output port 126 is extremely small, on the order of 0.005 inches, extending along a length corresponding to the width of the imaging area of the photoreceptor. The fluid transport channel 125 provides a path of travel for transporting liquid developer material from a liquid developing material reservoir 145 to the elongated aperture of output port 126 which defines an outlet from which the liquid developing material can flow for coating the surface of the photoreceptor belt 18 with a relatively thin layer of liquid developer material. A pump device 46 can be provided to facilitate the transport of liquid developer material through the fluid channel 125 and out of elongated aperture 126 such that the liquid developer material flows into contact with the surface of photoreceptor belt 18. The relatively small width of the elongated outlet port 126 tends to create a substantially uniform fluid flow when liquid developing material is pumped through the fluid transport channel 125. In addition, the relatively small width of the elongated outlet port 126 advantageously prevents fluid flow in the channel 125 when liquid developing material is not being pumped through the channel due to capillary action of the fluid in the channel.

In addition to a fluid delivery means described above, the liquid developing material coating flow applicator of the present invention includes means for manipulating the profile of the coating flow discharge from output port 126 to regulate the coating flow characteristics thereof. As such, the housing 124 also includes an air flow channel 127 coupled to an air inlet port 128 in the form of a second elongated aperture located just upstream from outlet port 126 relative to the path of motion of the photoreceptor belt 18. The air inlet port 128 is generally situated in substantial alignment with elongated aperture 126. The air channel 127 is coupled to a vacuum source 147 and provides a pathway for coupling the vacuum source to the area immediately upstream of the area in which liquid developing material is brought in contact with the photoreceptor via fluid channel 125. It has been found that the application of vacuum pressure and variation thereof via control valve 148 in this area can effect the profile of the liquid developing material flow from aperture 126, thereby permitting the creation of advantageous conditions for improved fluid flow stability and uniformity, as will be described.

Figure 2:
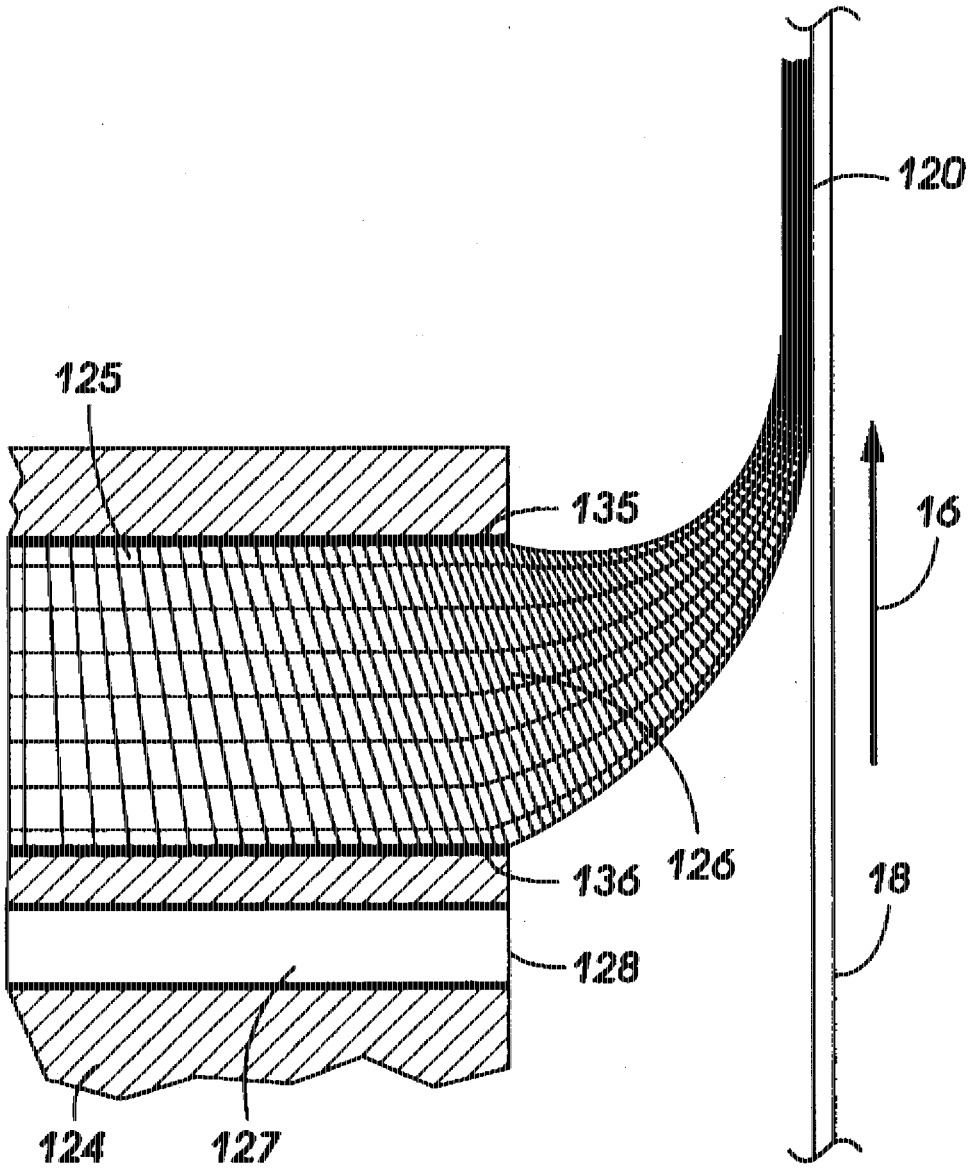
FIG. 2 is a computational mesh illustrating the liquid developing material flow profile utilizing the liquid developing material coating flow applicator of the present invention.

An analysis of the operation of the coating flow applicator of the present invention and the flow manipulation that can be provided thereby will be described with reference to FIG. 2. The fluid flow from output port 126 has two free surfaces: an upstream surface extending from the upstream wall 136 of fluid transport channel 125 adjacent aperture 126 to the dynamic point of contact where the fluid contacts the moving surface of the photoreceptor; and a downstream surface extending from the downstream wall 135 of fluid channel 125 adjacent aperture 126 to form the exposed surface of the coating layer 120 formed on the surface of the photoreceptor 18. Thus, the downstream surface of the fluid flow is subjected to atmospheric pressure while, due to the air inlet port 128 of the present invention, the upstream surface is subjected to vacuum, preferably of magnitude several inches of water below atmosphere. Under normal operating ranges of the vacuum, the flow pressure between the upstream and downstream surfaces of the fluid flow is substantially uniform and is generally closer to the pressure provided by the vacuum than the atmospheric pressure. As a result, it has been found that the variation in vacuum pressure has a stronger influence on the downstream surface of the fluid flow than on the upstream surface of the fluid flow. In addition, the applied vacuum pressure also has a significant influence on the location of the dynamic contact where the fluid flow contacts the moving surface of the photoreceptor 18.

Thus, in the present invention, the vacuum pressure applied in the region immediately upstream from the fluid flow is typically varied to influence the profile and/or the dynamic contact point of the fluid flow. Relatively low vacuum pressure at air inlet port 128 allows the dynamic contact point to move downstream while increasing the possibility of air entrainment and film rupture of the fluid flow coating due to two-dimensional instabilities in the fluid flow. Conversely, relatively high vacuum pressure generates three dimensional flow instabilities such as so-called ribbing instabilities. In essence, the stability of the fluid flow is determined by the proper application of the vacuum pressure. In sum, there is an operational range for which vacuum pressure at air inlet port 128 can be varied to provide appropriate hydrodynamic stability of fluid flows from outlet port 126. The coating flow applicator of the present invention is intended to provide a robust apparatus for forming substantially stable and uniform liquid layers of various thicknesses.

In addition to variation of vacuum pressure described above, it has been found that certain other parameters, including fluid viscosity; surface tension; receiving surface velocity; and geometric parameters such as aperture width, flow gap, and fluid film thickness, among others, can be advantageously exploited to achieve the desired result of providing stable and uniform fluid flow of various thicknesses. Thus, the stability of fluid flow in the liquid developing material coating flow applicator of the present invention can be governed by various parameters beyond vacuum pressure as described above. Of particular interest, is the variation of the outlet port 126 geometry for providing variation to the fluid flow profile and, in turn, for varying fluid flow stabilization and thickness. In particular, with reference to FIGS. 3A and 3B, it has been found by the present invention that by varying or offsetting the distance between the downstream wall 135 and the surface of the photoreceptor 18 relative to the distance between the upstream wall and the surface of the photoreceptor 18, the shape of the outcoming fluid may be varied to produce varying stress distributions in the fluid flow, and, in turn, to achieve optimized fluid flow stability.

Preferably, as can be seen from FIGS. 3A and 3B, raising up the downstream wall 135 can have significant advantageous effects on the fluid flow profile. Fluid flow parameters were tested for cases in which the offset differential between the upstream wall 136 and the downstream wall 135 at the outlet port, wherein the downstream wall was raised by from ½ to 2 times the width of the outlet port 126. FIG. 3A shows a computational model of the fluid flow profile with a raise in the downstream wall equivalent to one width of the outlet port 126, while FIG. 3B shows the computational model of the fluid flow profile with a raise in the downstream wall equivalent to twice the width of the outlet port 126. It can be shown through experimentation that even a substantially minimal raise in the downstream wall (on the order of only ½ the width of the outlet port 126), can produce a substantial impact on fluid flow stability. Moreover, it will be understood that certain conditions may arise wherein it may be advantageous to raise the upstream wall to produce a desired effect on the fluid flow from outlet port 126. It will be recognized that the outlet port 126 geometry can also be varied in combination with other parameters noted above to provide fluid flow stability characteristics as desired.

In review, the liquid developing material coating flow applicator of the present invention comprises a single piece housing including a fluid transport channel having a relatively narrow-width elongated outlet port for delivering a coating flow and an air flow channel having an elongated input aperture adjacent the coating flow for varying the profile thereof which allows variation of flow stability and uniformity, as well as thickness. A discussion of the effects of variations in the outlet port geometry, in particular, increasing the dimension between the downstream wall and the surface to be coated, has also been provided.

It is, therefore, apparent that there has been provided, in accordance with the present invention, an apparatus for applying a coating of liquid developing material to a moving surface such as the latent image bearing surface of a photoreceptor in an electrostatographic printing system. This apparatus fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. A liquid developing material coating flow applicator for applying a substantially uniform coating of liquid developing material to a moving surface, comprising:

a housing situated proximate to the moving surface, said housing defining a fluid transport channel coupled to an elongated outlet port located adjacent the moving surface for delivering a flow of liquid developing material thereto, and further defining an air flow channel coupled to an inlet port located adjacent the moving surface and immediately upstream from the elongated outlet port;

a vacuum source coupled to the air flow channel for providing vacuum pressure thereto to apply vacuum pressure to the flow of liquid developing material; and a mechanism for selectively varying, within an operational range, the vacuum pressure applied to the flow of liquid developing material to provide hydrodynamic stability thereto.

2. The liquid developing material coating flow applicator of claim 1, wherein the outlet port has a width of approximately 0.005 inches.

3. The liquid developing material coating flow applicator of claim 1, further including a liquid developing material reservoir coupled to the fluid transport channel for providing a supply of liquid developing material thereto.

4. The liquid developing material coating flow applicator of claim 3, further including a mechanism for pumping the liquid developing material from said liquid developing material reservoir to the fluid transport channel.

5. The liquid developing material coating flow applicator of claim 1, wherein the elongated outlet port is situated substantially transverse to a path of travel of the moving surface.

6. The liquid developing material coating flow applicator of claim 1, wherein the fluid transport channel includes an upstream wall and a downstream wall extending to a peripheral surface of said housing adjacent the moving surface for defining the outlet port.

7. The liquid developing material coating flow applicator of claim 6, wherein a distance from said downstream wall and the moving surface at the outlet port is greater than the distance from said upstream wall and the moving surface at the outlet port.

8. The liquid developing material coating flow applicator of claim 7, wherein an offset differential between said downstream wall at the outlet port and said upstream wall at the outlet port is in a range of ½ to 2 times the outlet port width.

9. An apparatus for developing an electrostatic latent image on an imaging member with a liquid developing material, comprising:

a liquid developing material coating flow applicator for applying a substantially uniform coating of liquid developing material to an imaging member, including a housing situated proximate to the imaging member, said housing defining a fluid transport channel coupled to an elongated outlet port located adjacent the imaging member for delivering a flow of liquid developing material thereto, and further defining an air flow channel coupled to an inlet port located adjacent the imaging member and immediately upstream from the elongated outlet port;

a vacuum source coupled to the air flow channel for providing vacuum pressure thereto to apply vacuum pressure to the flow of liquid developing material and a mechanism for selectively varying, within an operational range, the vacuum pressure applied to the flow of liquid developing material to provide hydrodynamic stability thereto.

10. The apparatus of claim 9, wherein outlet port has a width of approximately 0.005 inches.

11. The apparatus of claim 9, further including a liquid developing material reservoir coupled to the fluid transport channel for providing a supply of liquid developing material thereto.

12. The apparatus of claim 11, further including a mechanism for pumping the liquid developing material from said liquid developing material reservoir to the fluid transport channel.

13. The apparatus of claim 9, wherein the elongated outlet port is situated substantially transverse to a path of travel of the imaging member.

14. The apparatus of claim 9, wherein the fluid transport channel includes an upstream wall and a downstream wall extending to a peripheral surface of said housing adjacent the imaging member for defining the outlet port.

15. The apparatus of claim 14, wherein a distance from said downstream wall and the imaging member at the outlet port is greater than the distance from said upstream wall and the imaging member at the outlet port.

16. The apparatus of claim 15, wherein an offset differential between said downstream wall at the outlet port and said upstream wall at the outlet port is in a range of ½ to 2 times the outlet port width.

17. The apparatus of claim 9, further including means for electrically biasing said metering roll for attracting the liquid developing material to image areas of the electrostatic latent image.

18. The apparatus of claim 15, further including means for rotating said metering roll in a direction opposite the path of travel of the imaging member to create a shear force for minimizing a thickness of the liquid developing material on the imaging member.

19. A liquid ink type electrostatographic printing machine including an apparatus for developing an electrostatic latent image on a photoreceptive member with a liquid developing material, comprising:

a liquid developing material coating flow applicator for applying a substantially uniform coating of liquid developing material to a photoreceptive member, including;

a housing situated proximate to the photoreceptive member, said housing defining a fluid transport channel coupled to an elongated outlet port located adjacent the photoreceptive member for delivering a flow of liquid developing material thereto and further defining an air flow channel coupled to an inlet port located adjacent the photoreceptive member and immediately upstream from the elongated outlet port for applying vacuum pressure to the flow of liquid developing material;

a vacuum source coupled to the air flow channel for providing vacuum pressure thereto to apply vacuum pressure to the flow of liquid developing material;

a mechanism for selectively varying, within an operational range, the vacuum pressure applied to the flow of liquid developing material to provide hydrodynamic stability thereto; and a metering roll situated adjacent said liquid developing material coating flow applicator and downstream therefrom relative to a path of travel of the photoreceptive member.

20. The liquid ink type electrostatographic printing machine of claim 19, wherein the outlet port has a width of approximately 0.005 inches.

21. The liquid ink type electrostatographic printing machine of claim 19, further including a liquid developing material reservoir coupled to the fluid transport channel for providing a supply of liquid developing material thereto.

22. The liquid ink type electrostatographic printing machine of claim 21, further including means for pumping the liquid developing material from said liquid developing material reservoir to the fluid transport channel.

23. The liquid ink type electrostatographic printing machine of claim 19, wherein the elongated outlet port is situated substantially transverse to a path of travel of the photoreceptive member.

24. The liquid ink type electrostatographic printing machine of claim 19, wherein the fluid transport channel includes an upstream wall and a downstream wall extending to a peripheral surface of said housing adjacent the photoreceptive member for defining the outlet port.

25. The liquid ink type electrostatographic printing machine of claim 24, wherein a distance from said downstream wall and the photoreceptive member at the outlet port is greater than the distance from said upstream wall and the photoreceptive member at the outlet port.

26. The liquid ink type electrostatographic printing machine of claim 25, wherein an offset differential between said downstream wall at the outlet port and said upstream wall at the outlet port is in a range of ½ to 2 times the outlet port width.

27. The liquid ink type electrostatographic printing machine of claim 19, further including means for electrically biasing said metering roll for attracting the liquid developing material to image areas of the electrostatic latent image.

28. The liquid ink type electrostatographic printing machine of claim 19, further including means for rotating said metering roll in a direction opposite the path of travel of the photoreceptive member to create a shear force for minimizing a thickness of the liquid developing material on the photoreceptive member.

* * * * *